US006595360B2

(12) United States Patent
Ueno et al.

(10) Patent No.: US 6,595,360 B2
(45) Date of Patent: Jul. 22, 2003

(54) FASTENING ELEMENT

(75) Inventors: Hideyuki Ueno, Kanagawa (JP); Akihiro Goto, Aichi (JP)

(73) Assignees: Kotec's Co., Ltd., Tokyo (JP); Sanyo Seisakusho Co., Ltd., Aichi (JP)

( * ) Notice: Subject to any disclaimer, the term of this patent is extended or adjusted under 35 U.S.C. 154(b) by 0 days.

(21) Appl. No.: 09/812,858

(22) Filed: Mar. 21, 2001

(65) Prior Publication Data

US 2001/0023836 A1 Sep. 27, 2001

(30) Foreign Application Priority Data

Mar. 21, 2000 (JP) ..... 2000-078707

(51) Int. Cl.[7] ..... B65D 85/24
(52) U.S. Cl. ..... 206/343
(58) Field of Search ..... 206/343, 345, 206/346, 347, 348

(56) References Cited

U.S. PATENT DOCUMENTS 3,802,987 A * 4/1974 Noll ..... 156/244.11
4,679,975 A * 7/1987 Leistner ..... 206/343
5,772,073 A 6/1998 Deschenes
5,799,375 A 9/1998 Fukami
6,220,434 B1 * 4/2001 Kubota et al. ..... 140/93.2

FOREIGN PATENT DOCUMENTS

GB 2 103 274 2/1983

* cited by examiner

*Primary Examiner*—Shian Luong
(74) *Attorney, Agent, or Firm*—Young & Thompson

(57) ABSTRACT

A fastening element with less jamming during operation includes a plurality of a unit fastening element arranged adjacently, each unit fastening element including a filament section, an inserting head section equipped with a suitable engagement section located at one end of the filament section, and a socket section equipped with a hole for irreversibly passing the inserting head section located at the other end of the filament section, where a plurality of the socket sections or their vicinities arranged adjacent to each other are temporarily fixed to the connection bar section individually installed, respectively, and a plurality of optional filament sections adjacent to each other are separably fixed temporarily.

19 Claims, 4 Drawing Sheets

FASTENING ELEMENT

BACKGROUND OF THE INVENTION

1. Field of the Invention

The present invention relates to a fastening element for sealing after attaching tags such as brand labels, price labels, material descriptions, instruction manuals, etc. to products such as garments, shoes, bags, etc. In particular, the present invention relates to a fastening element whose filament section does not get entangled when the fastening element is set to a specially designed fastening element attaching device (a gun) for attaching the tags.

2. Description of the Related Art

In general, for binding garments, ladies boots, sandals, shoes, etc. or attaching brand labels, price labels, etc. to the products, a fastening element as shown in FIG. 6 has been used.

In FIG. 6, the fastening element comprises a filament section 5 that forms a loop by passing the tag, an inserting head section 6 mounted to one end of the filament section and equipped with a head section 6*a*, and a socket section 8 mounted to the other end of the filament section 5 and provided with a hole 7 for irreversibly passing the inserting head section 6.

And a plurality of fastening element 4 are temporarily fixed to two connection bars 11 so that the filament section 5 keeps in parallel to each other.

The example of a fastening element of the present invention as shown in FIG. 6 is formed integrally into one unit preferably with synthetic resin, etc., and in particular, the filament section 5 is drawn and is extremely resistant to a longitudinal tension. In addition, when the inserting head portion 5 of the filament section passes the hole section 10 of the socket portion 8, that has a narrowed passage formed with a pair of blades formed inside the socket portion and the pair of the blades engaged to a reduced neck section 6*a* of the inserting head section 6, and thereby, the inserting head section 6 is irreversibly fixed inside the socket section 8, and the loop-like formed label fixing condition is completed, and sealing is achieved.

Conventionally, these fastening elements are loaded to the specially designed fastening element attaching device (a mounting gun), and have been used not only for binding boots, sandals, or shoes but also primarily for fixing the brand label or tag T describing the directions for use to products.

However, with the conventional fastening element, when a large number of filament sections 5 arranged in the plane condition in parallel to each other, are mounted to the specially designed fastening element attaching device (a mounting gun) and each being used by being shotted out, successively, the plurality of the unit filament sections arranged adjacently to each other, are frequently get tangled with each other, causing the shooting operation for shooting out each one of the unit of fastening elements to be impossible as well as causing jamming condition on the fastening element attaching device due to such entanglement thereof.

In addition, when the filament sections in the plane condition are stocked or transferred, each one of the unit filament sections are frequently entangled to each other and if so, an operator must make them disconnected separately from the fastening element at every time when the operator wishes to use them actually and thus the operation thereof becomes troublesome.

Accordingly, it is an object of the present invention to provide a fastening element in that a plurality of the filament sections are arranged and fixed parallely to each other one another so as to prevent the entanglement when it is set on a specially designed fastening element attaching device and to improve the work efficiency, and additionally prevents from jamming caused by the entanglement of the filament sections.

SUMMARY OF THE INVENTION

In order to solve the problems to be solved as mentioned above, the present invention basically adopts the configuration as recited below. That is, the first aspect of the present invention relates to a fastening element comprising a plurality of a unit fastening element arranged adjacently and in parallelism with each other, each of the unit fastening element comprising a filament section, an inserting head section equipped with a suitable engagement section located at one end of the filament section, and a socket section equipped with a hole for irreversibly passing the inserting head section, located at the other end of the filament section, the fastening element characterized in that a plurality of the socket sections or their vicinities each being adjacently arranged to each other and a plurality of the inserting head sections or their vicinities each being adjacently arranged to each other, are temporarily and individually connected to each one of connection bars, respectively, and further at least parts of each one of a selected plurality of the filament sections adjacently arranged to each other, are separably and temporarily connected to each other.

The second aspect of the present invention relates to the fastening element characterized in that in the above-mentioned fastening element, among the unit fastening elements, an unit fastening element which has no connected portion thereon to at least one of the other fastening elements and a portion in which parts of a plurality of the fastening elements adjacently arranged to each other being temporarily connected to each other, are arranged alternately.

The third aspect of the present invention relates to the fastening element characterized in that in the above-mentioned fastening element, each one of the connected portions is formed with parts of each one of two adjacently arranged fastening elements.

The fourth aspect of the present invention relates to the fastening element characterized in that in the above-mentioned fastening element, each one of the connected portions is formed with parts of each one of three adjacently arranged fastening elements.

The fifth aspect of the present invention relates to the fastening element characterized in that in the above-mentioned fastening element, each one of the connected portions is formed with parts of each one of four adjacently arranged fastening elements.

In the present invention, parts of some of the unit fastening elements adjacently arranged to each other are temporarily and separably connected to each other in order to solve the above-mentioned drawbacks in the past, and thus entanglement among a plurality of unit filament sections is able to be prevented, and when the fastening element is mounted on the fastening element attaching device, each one of the fastening element is able to be smoothly shotted out without occurring any jamming condition.

DETAILED DESCRIPTION OF THE PREFERRED EMBODIMENTS

The fastening element according to the present invention can prevent the filament sections from snarling and jamming and at the same time can be set to a special-purpose coupler gun free of trouble because optional plurality of adjacent filament sections are separably fixed temporarily.

Figure 1:
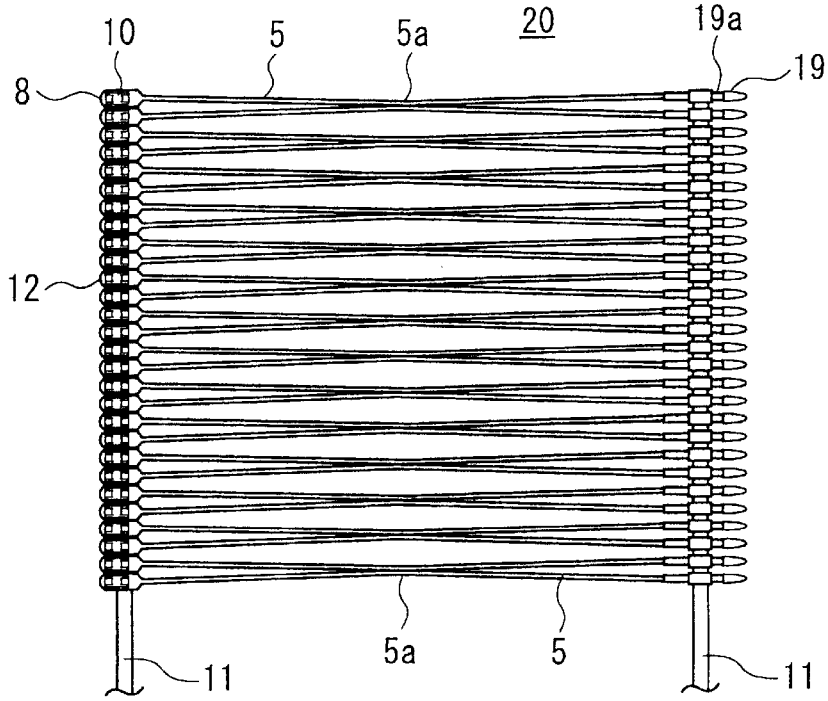
FIG. 1 is a front view showing the first embodiment of the fastening element related to the present invention.

Referring now to drawings, the configuration of one specific example of the fastening element according to the present invention will be described in detail. That is, FIG. 1 is a front view showing the first example of the fastening element according to the present invention. First of all, the basic configuration of the fastening element 20 according to the present invention is nearly same as that of the conventional fastening element. In the present invention, the cross-sectional profile of the filament section 5 may be any of circle, flat shape, and rectangle. In addition, to the hole 10 of the socket section 8, a blade 12 that can enable engagement of the neck section 19*a* of the inserting head section 19 is disposed.

A fastening element 20 according to the present invention comprises a plurality of a unit fastening element arranged adjacently, the unit fastening element comprising a filament section 5, an inserting head section 19 equipped with a suitable engagement section located at one end of the filament section 5, and a socket section 8 equipped with a hole 10 for irreversibly passing the inserting head section 19 located at the other end of the filament section 5, and the fastening element is characterized in that a plurality of the socket sections 8 or their vicinities arranged adjacent to a plurality of relevant inserting head sections 19 or their vicinities are temporarily fixed to the connection bar section 11 individually installed, respectively, and a plurality of optional filament sections 5 adjacent to each other are separably fixed temporarily.

The number of filaments to be temporarily fixed may be the same number or may be varied to 2, 3, or 4 successively, and these numbers may be repeatedly fixed temporarily.

In the example shown in FIG. 1, two each of the filament section 5 are temporarily fixed nearly at the center section 5*a*. The filament section 5 may be formed in the temporarily fixed condition inside the dies when they are injection-molded. Furthermore, the filament section 5 may be temporarily fixed in another process after injection-molding. The socket section 8 and the inserting head section 19 and the connection bar 11 are joined in an easy-to-cut condition. Furthermore, the fastening element 20 according to the present invention is, in general, formed integral by nylon, polypropylene, polyester, or other synthetic resins.

Figure 2:
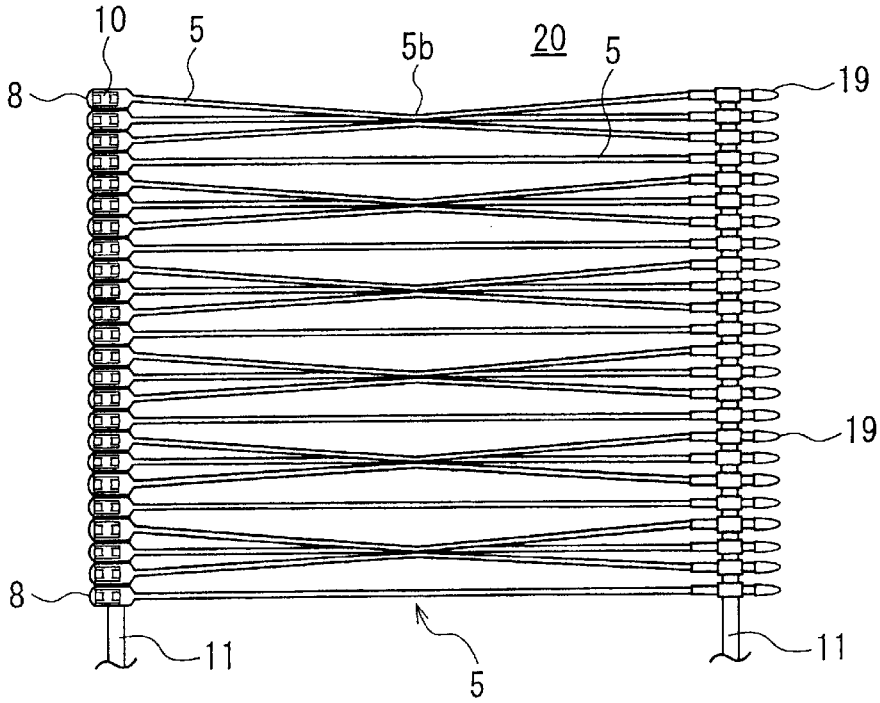
FIG. 2 is a front view showing the second embodiment of the fastening element related to the present invention.

FIG. 2 is a front view showing the second embodiment of the fastening element. In the present embodiment, three filament sections brought together and temporarily fixed at the center section 5*b* and one independent filament section 5 are alternately arranged. Optional combinations are available for the arrangement of the adjacent filament sections 5 with a plurality of filaments temporarily fixed and not temporarily fixed.

Figure 3:
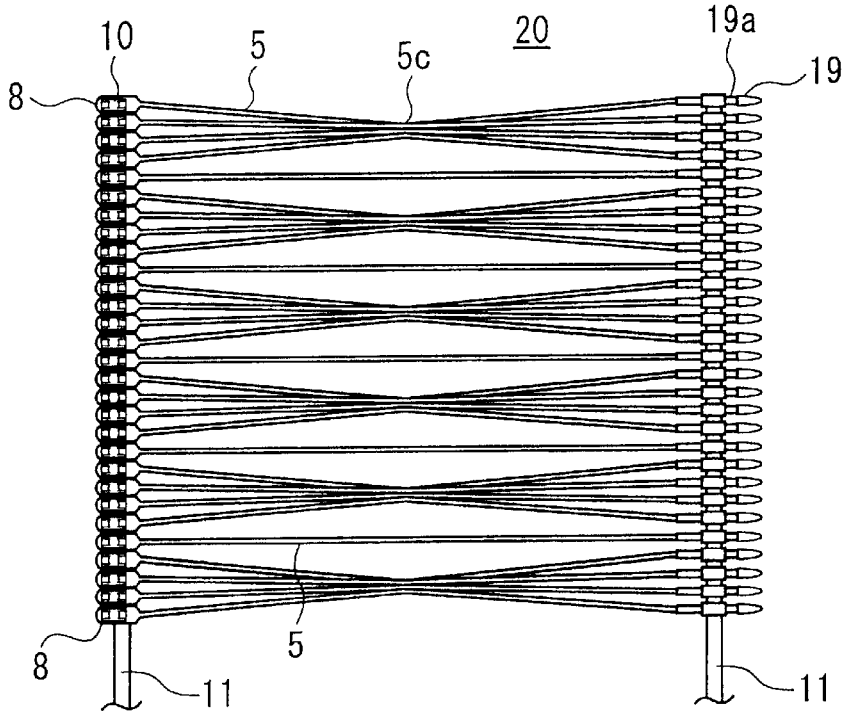
FIG. 3 is a front view showing the third embodiment of the fastening element related to the present invention.

FIG. 3 is a front view showing the third embodiment of the fastening element. In the present embodiment, of adjacent filament sections 5, four filament sections temporarily fixed nearly at the center section 5*c* and one not temporarily fixed filament section 5 are alternately arranged.

Even when the filament sections are arranged in this way, snarling of the filament sections 5 is able to be prevented when the fastening element 20 is stored or transported.

Figure 4:
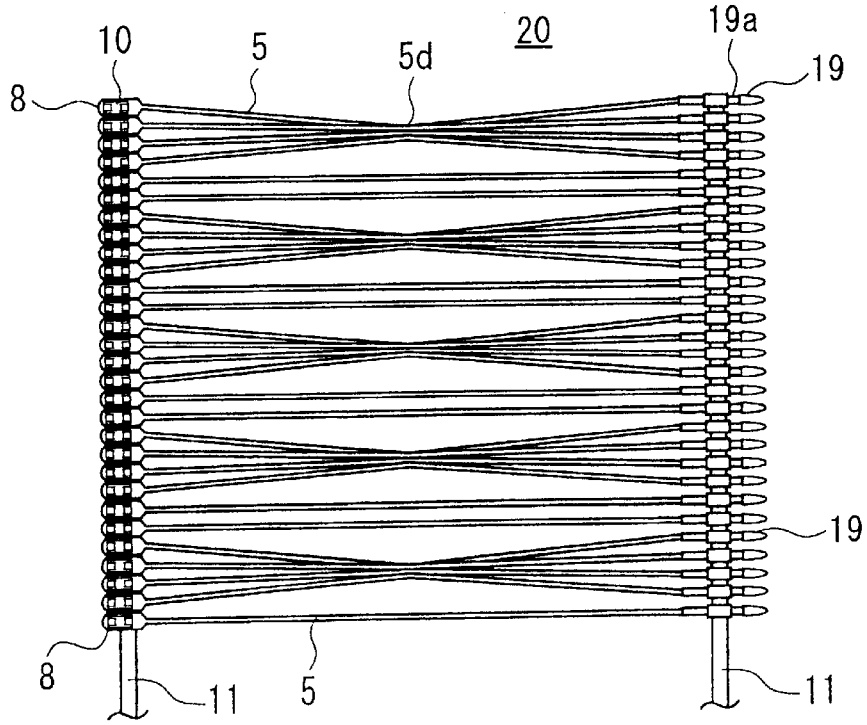
FIG. 4 is a front view showing the fourth embodiment of the fastening element related to the present invention.

FIG. 4 is a front view showing the fourth embodiment of the fastening element. In the present embodiment, of adjacent filament sections 5, four filament sections temporarily fixed nearly at the center section 5*d* and two not temporarily fixed filament sections 5 are alternately arranged.

Even the foregoing configuration can effectively prevent snarling of adjacent filament sections 5.

For another embodiment, the filament section 5 may have the filament itself formed by previously curving or bending and a plurality of filament sections temporarily fixed to at least part of the filament section 5 in order to prevent snarling of adjacent filament sections 5. The filament section may be curved by irreversibly bending by fixing using heat-setting, etc.

Even when the filament section is formed in this way, snarling of the curved filament section 5 is able to be prevented and at the same time, the curved filament section 5 is able to be easily mounted to the coupler gun.

Figure 5:
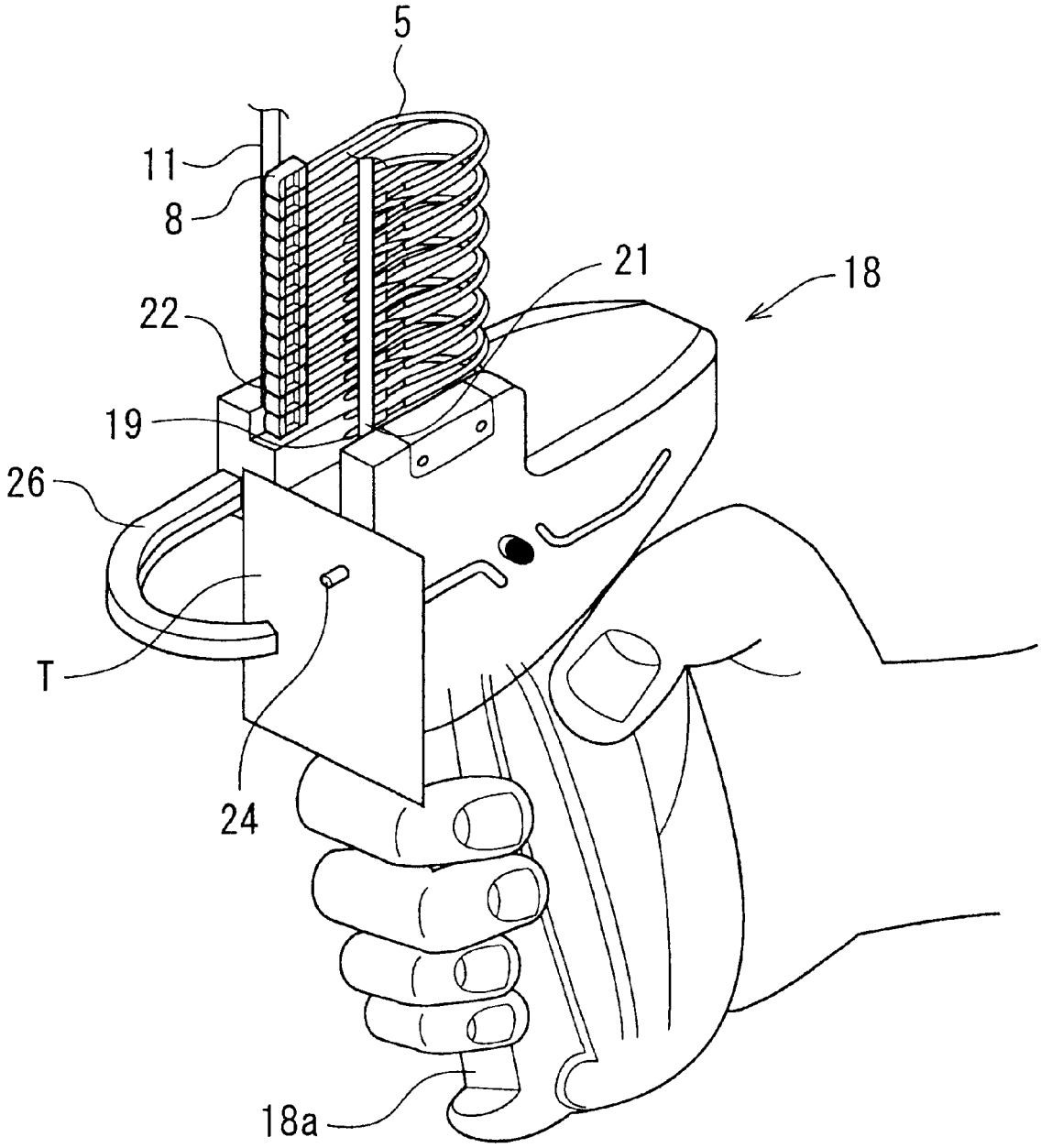
FIG. 5 is a perspective view showing the condition in which the fastening element according to the present invention is set to the special-purpose coupler gun (gun)
Figure 6:
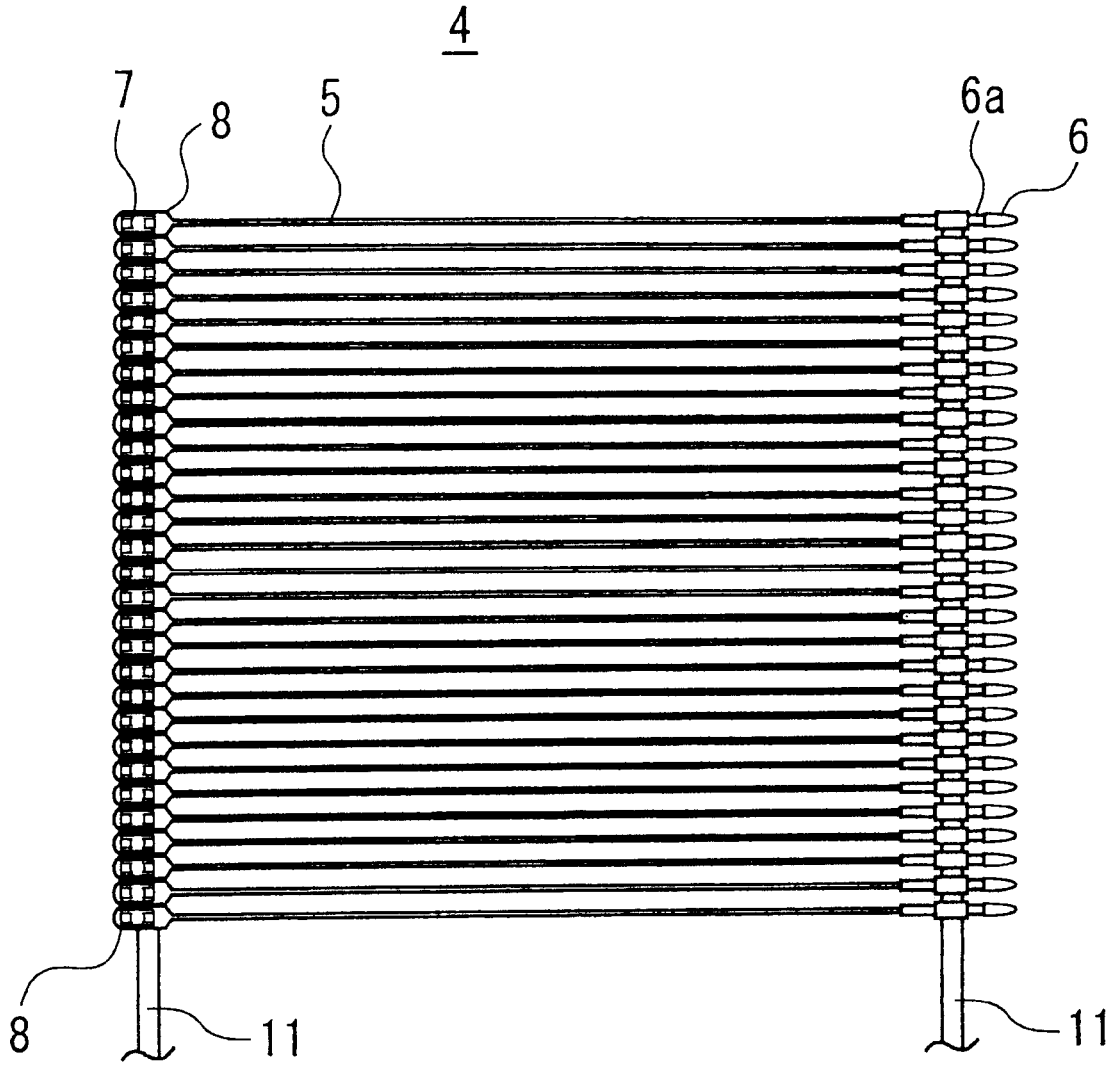
FIG. 6 is a front view showing one example of the conventional fastening element.

FIG. 5 is a perspective view of the coupler gun that uses the fastening element according to the present invention. Now, to the coupler gun 18, longitudinal grooves 21, 22 are formed on the right and the left for inserting the connection bar 11 of the fastening element 20. To the longitudinal groove 21, for example, the connection bar 11 that connects the socket section 8 of the fastening element 20 is inserted, and to the longitudinal groove 22, the connection bar 11 that connects the inserting head section 19 is inserted.

In addition, the coupler gun 18 is disposed with a coupling pin driven by the lever 18*a* operation illustrated on the side of the longitudinal groove 22 which separates the inserting head section 19 from the connection section of the connection bar 11 and presses out the inserting head section forwards along the tubular guide needle 24 one by one.

On the other hand, the socket section 8 inserted in the longitudinal groove 21 is separated from the connection section of the connection bar 11 by the press-out belt not illustrated and pressed out forwards along the curved socket section guide 26 one by one. The socket section 8 pressed out along the socket section guide 26 is turned 90° and at the hole section 10, it is fitted into the inserting head section 19 pressed by the coupling pin not illustrated at the head end section.

The socket section guide 26 is formed in a tubular shape so that it can turn the direction about 90° and at the same time the press-out belt is able to advance meandering inside. And it is configured in such a manner that the timing of the head end of the press-out belt reaching the head end of the socket section guide 26 coincides with the timing of the coupling pin reaching the tip end of the socket section guide 26. In this way, the fastening element 20 is able to attach labels to products successively and continuously.

The filament section used in the fastening element related to the present invention may have a circular cross section or flat, oval, or rectangular cross section. Furthermore, the size of the socket section is preferably small enough for easy handling and small by appearance.

The present invention is able to provide various remarkable operation effects by adopting the configurations as described above, and snarling of filament sections is able to be prevented because a plurality of adjacent filament sections are temporarily fixed when the fastening element is mounted to the special coupler gun that can continuously couple the fastening element by pulling the lever, and when the fastening element is loaded to the coupler gun, the device is able to be smoothly operated and occurrence of jamming is able to be prevented.

What is claimed is:

1. A fastening element, comprising:

a plurality of unit fastening elements arranged adjacently and in parallel with each other, each of said unit fastening elements comprising a filament section, an inserting head section equipped with a suitable engagement section located at one end of the filament section, and a socket section equipped with a hole for irreversibly passing the inserting head section, located at another end of the filament section;

a first connecting bar temporarily supporting a plurality of said socket sections adjacently arranged to each other; and a second connecting bar temporarily supporting a plurality of said mine ting head sections adjacently arranged to each other, some of the unit fastening elements being temporarily connected, by contact, to each other at a connected portion located along the filament sections intermediate the inserting head sections and the socket sections, wherein one of said connected portions is formed with parts of at least two adjacently arranged fastening elements.

2. A fastening element according to claim 1, wherein one of said connected portions is formed with parts of three adjacently arranged fastening elements.

3. A fastening element according to claim 1, wherein one of said connected portions is formed with parts of four adjacently arranged fastening elements.

4. A fastening element according to claim 1, wherein said connected portions are located midway between the inserting head sections and the socket sections.

5. A fastening element according to claim 1, wherein said filament sections temporarily connected to each other at the connected portions each comprise only a single connected portion.

6. A fastening element according to claim 1, wherein aid filament sections having connected portions and being temporarily connected to each other, are arranged non-parallel to each other.

7. A fastening element, comprising:

a plurality of unit fastening elements arranged adjacently and in parallel with each other, each of said unit fastening elements comprising a filament section, a inserting head section equipped with a suitable engagement section located at one end of the filament section, and a socket section equipped with a hole for irreversibly passing the inserting head section, located at another end of the filament section;

a first connecting bar temporarily supporting a plurality of said socket sections adjacently arranged to each other; and a second connecting bar temporarily supporting a plurality of said inserting head sections adjacently arranged to each other, some of the unit fastening elements being temporarily connected to each other at a connected portion located along the filament sections intermediate the inserting head sections and the socket sections, wherein said first and second connecting bars temporarily supporting said socket sections and said inserting head sections show level of a connecting condition under which said connecting bar can be separated by a longitudinal tension applied to one of said filament sections when it is about to be shotted out in carrying out a fastening element shooting operation utilizing a fastening element attaching device.

8. A fastening element according to claim 7, wherein among said plurality of unit fastening elements;

one unit fastening element has no temporarily connected portion thereon to an other unit fastening elements adjacently arranged thereto; and a group of two unit fastening elements each being adjacently arranged to each other and between which portions of said respective unit fastening elements are temporarily connected to each other, are arranged alternately.

9. A fastening element according to claim 7, wherein one of said connected portions is formed with parts of two adjacently arranged fastening elements.

10. A fastening element according to claim 7, wherein one of said connected portions is formed with parts of three adjacently arranged fastening elements.

11. A fastening element according to claim 7, wherein one of said connected portions is formed with parts of four adjacently arranged fastening elements.

12. A fastening element, comprising:

a plurality of unit fastening elements arranged adjacently and in parallel with each other, each of said unit fastening elements comprising a filament section, a inserting head section equipped with a suitable engagement section located at one end of the filament section, and a socket section equipped with a hole for irreversibly passing the inserting head section, located at another end of the filament section;

a first connecting bar temporarily supporting a plurality of said socket sections adjacently arranged to each other; and a second connecting bar temporarily supporting a plurality of said inserting head sections adjacently arranged to each other, some of the unit fastening elements being temporarily connected to each other at a connected portion located along the filament sections intermediate the inserting head sections and the socket sections, wherein among said unit fastening elements, at least one unit fastening element has no connected portion thereon and is free of connection, along its filament section, to any adjacent unit fastening elements.

13. A fastening element according to claim 12, wherein one of said connected portions is formed with parts of two adjacently arranged fastening elements.

14. A fastening element according to claim 12, wherein one of said connected portions is formed with parts of three adjacently arranged fastening elements.

15. A fastening element according to claim 12, wherein one of said connected portions is formed with parts of four adjacently arranged fastening elements.

16. A fastening element, comprising:

a plurality of unit fastening elements arranged adjacently and in parallel with each other, each of said unit fastening elements comprising a filament section, an inserting head section equipped with a suitable engagement section located at one end of the filament section, and a socket section equipped with a hole for irreversibly passing the inserting head section, located at another end of the filament section;

a first connecting bar temporarily supporting a plurality of said socket sections adjacently arranged to each other; and a second connecting bar temporarily supporting a plurality of said inserting head sections adjacently arranged to each other, some of the unit fastening elements being temporarily connected, by contact, to each other at a connected portion located along the filament sections intermediate the inserting head sections and the socket sections, wherein, among said unit fastening elements, at least one unit fastening element ha no connected portion thereon and is free from temporary connection to any of said other fastening elements, and a portion of said unit fastening elements in which parts of at least three adjacently arranged fastening elements are temporarily connected to each other, are arranged alternately.

17. A fastening element according to claim 14, wherein, among said unit fastening elements, a portion of said unit fastening elements in which parts of four adjacently arranged fastening elements are temporarily connected to each other, are arranged alternately.

18. A fastening element, comprising:

a plurality of unit fastening elements arranged adjacently and in parallel with each other, each of said unit fastening elements comprising a filament section, an inserting head section equipped with a suitable engagement section located at one end of the filament section, and a socket section equipped with a hole for irreversibly passing the inserting head section, located at another end of the filament section;

a first connecting bar temporarily supporting a plurality of said socket sections adjacently arranged to each other; and a second connecting bar temporarily supporting a plurality of said inserting head sections adjacently arranged to each other, some of the unit fastening elements being temporarily connected, by contact, to each other at a connected portion located along the filament sections intermediate the inserting head sections and the socket sections, wherein, among said unit fastening elements, two adjacent unit fastening elements each have no connected portion thereon and are free of connection to each other and to any other fastening elements.

19. A fastening element, comprising:

a plurality of unit fastening elements arranged adjacently and in parallel with each other, each of said unit fastening elements comprising a filament section, an inserting head section equipped with a suitable engagement section located at one end of the filament section, and a socket section equipped with a hole for irreversibly passing the inserting head section, located at another end of the filament section;

a first connecting bar temporarily supporting a plurality of said socket sections adjacently arranged to each other; and a second connecting bar temporarily supporting a plurality of said inserting head sections adjacently arranged to each other, some of the unit fastening elements being temporarily connected, by contact, to each other at a connected portion located along the filament sections intermediate the inserting head sections and the socket sections, wherein, among said unit fastening elements with connected portions, a plurality of unit fastening elements having no connected portions are mixedly provided.

* * * * *